US005187460A

United States Patent [19]

Forterre et al.

[11] Patent Number: 5,187,460

[45] Date of Patent: Feb. 16, 1993

[54] MICROSTRIP LINE RESONATOR WITH A FEEDBACK CIRCUIT

[75] Inventors: Gérard E. E. Forterre, Colombes; Pierre Guillon, Limoges, both of France

[73] Assignee: Tekelec Airtronic, France

[21] Appl. No.: 665,816

[22] Filed: Mar. 7, 1991

[30] Foreign Application Priority Data

Mar. 9, 1990 [FR] France ..... 90 03057

[51] Int. Cl.[5] ..... H01P 7/08; H01P 1/203

[52] U.S. Cl. ..... 333/219; 333/205

[58] Field of Search ..... 333/202, 204, 205, 219, 333/235; 331/107 SL; 330/56, 109, 286

[56] References Cited

U.S. PATENT DOCUMENTS

| | | | |
|---|---|---|---|
| 4,262,269 | 4/1981 | Griffin et al. | 333/204 |
| 4,264,881 | 4/1981 | De Ronde | 333/204 |
| 4,323,855 | 4/1982 | Gerlach | 333/219 X |
| 4,604,591 | 8/1986 | Vasile | 333/164 X |
| 4,816,788 | 3/1989 | Ishikawa et al. | 333/204 X |
| 5,021,757 | 6/1991 | Kobayashi et al. | 333/205 |

FOREIGN PATENT DOCUMENTS

| | | | |
|---|---|---|---|
| 0071508 | 2/1983 | European Pat. Off. | 333/204 |
| 2321771 | 3/1977 | France . | |
| 2613538 | 10/1988 | France . | |
| 0286002 | 11/1988 | Japan | 333/204 |
| 0044802 | 2/1990 | Japan | 333/219 |
| 1298817 | 3/1987 | U.S.S.R. | 333/204 |
| 2222312 | 2/1990 | United Kingdom . | |

*Primary Examiner*—Paul M. Dzierzynski
*Assistant Examiner*—Seung Ham
*Attorney, Agent, or Firm*—Ostrolenk, Faber, Gerb & Soffen

[57] ABSTRACT

A dielectric resonator has a pattern of metallic microwave strips deposited onto a dielectric substrate having a high relative permittivity. The pattern is of a generally annular shape and has a slot formed in the annular pattern. The resonator includes an positive feedback circuit coupled thereto having an active element, such as a transistor, and is usable, for instance, as a band-cut off or band-pass filter.

11 Claims, 2 Drawing Sheets

A
B
C
VI
VII
1
2
3
4
6
7
8
11
13
14
15
16

MICROSTRIP LINE RESONATOR WITH A FEEDBACK CIRCUIT

BACKGROUND OF THE INVENTION

The invention relates to a dielectric resonator of the kind comprising a pattern of micro-wave metal strips on a dielectric substrate having a large relative permittivity and of generally annular shape provided with a slot or gap and to filters using such a resonator.

There are already known resonators and filters of this type, which however, suffer from the major inconveniences inherent in their structures that they exhibit substantial transmission losses.

SUMMARY OF THE INVENTION

To achieve the purpose of removing such drawbacks, a dielectric resonator according to the invention is provided that comprises an inverse feedback loop circuit comprising an active element such as a transistor.

According to an advantageous embodiment of the invention, the feedback circuit comprises micro-wave metal strips which are deposited onto the dielectric substrate at a very small distance from the micro-wave strips to provide for a suitable coupling.

According to another advantageous embodiment of the invention, the resonator comprises at least one variable capacitance element mounted onto the pattern of micro-wave strips at the slot or gap of the ring.

According to still a further advantageous feature of the invention, the pattern of micro-wave strips is of the hair-pin type comprising, at the slot of the ring, two parallel microwave strip sections extending towards the center of the ring and the variable capacitance element, such as a variable capacitance diode, is mounted between the end of one of these sections and ground.

According to still another advantageous feature of the invention, the variable capacitance element comprises a diode of the so-called "vertical" type such as a MESA-type diode.

A filter such as a band-cut off (notch) filter or a band-pass filter according to the invention comprises a dielectric resonator exhibiting the above-mentioned features.

BRIEF DESCRIPTION OF THE DRAWINGS

The invention will be better understood further objects, details, features and advantages thereof will appear more clearly as the following explanatory description proceeds with reference to the accompanying diagrammatic drawings given by way of non limiting example only, illustrating several embodiments of the invention and wherein.

DETAILED DESCRIPTION

Figures 1, 2, 3, 4, 5:
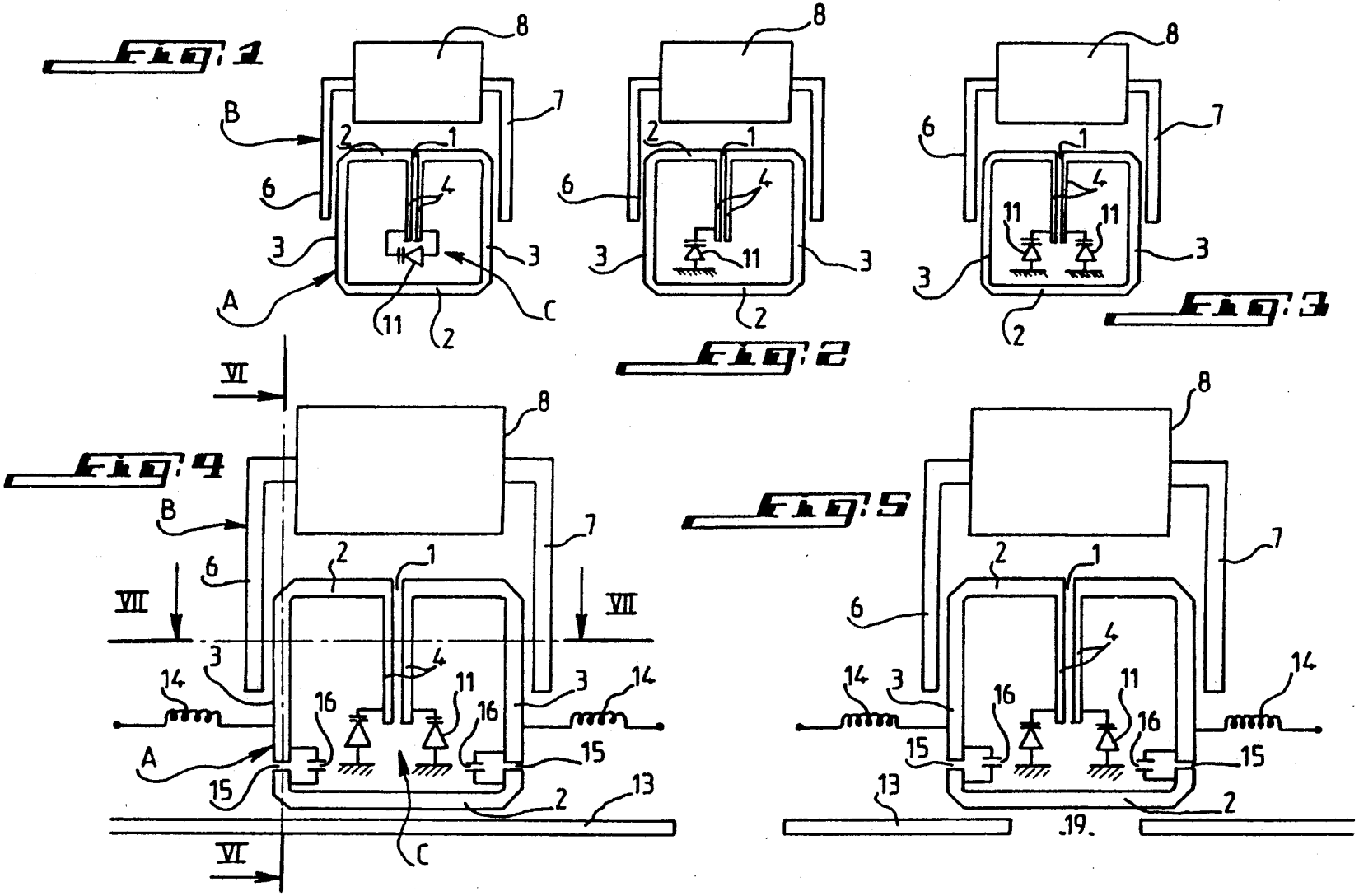
FIGS. 1 to 3 diagrammatically show three embodiments of a dielectric resonator according to the invention which are distinguished by the arrangement of the variable capacitance element allowing the variation in the resonance frequency.
FIGS. 4 and 5 are diagrammatic illustrations of stop and band-pass filters, respectively, which comprise a dielectric resonator according to FIG. 3.

The dielectric resonator according to FIGS. 1 to 3 comprises a pattern of micro-wave metal strips A of generally annular shape and split at 1. In the example shown, the pattern exhibits a generally square shape comprising two horizontal parallel strip elements 2 and two vertical strip elements 3. The pattern is of the hair-pin line type, i.e. comprising at the slit 1 in the middle of the upper strip 2, two metallic strip sections or fingers 4 which are parallel and extend towards the center of the ring-shaped pattern in parallel relation to the strips 3. These strip sections exhibit a predetermined length and form coupling lines. The metallic pattern shown is deposited onto a support or backing made from a dielectric material having a high relative permittivity such as, for instance, silicon, intrinsic or dielectric ceramic GaAs and in a general manner dielectrics which are stable in accordance with the temperature such as the materials marketed by the assignee hereof, Takelec Airtronic, Sevres, France, under the commercial brands E 2036 and E 3036 having a value $\Sigma r=37$ according to any suitable known process, for instance, through evaporation under vacuum. The circuit pattern could be provided on a substrate of the Duroid 5870 type having a thickness of 0.503 mm and a permittivity of 2.32.

Associated with this volume resonator structure is an positive feedback circuit B comprising a micro-wave metal strip of general C-shape the legs of which form the strip elements 6, 7 extending in parallel relation to the micro-wave strips 3 of the pattern A and arranged very close thereto. At the base of the positive feedback circuit an active electronic element such as a transistor diagrammatically shown at 8 is arranged. Associated as a discrete component with the active element 8 may be a phase-rotation device (not shown). The function of phase rotation may, however, also be accomplished by the strips (6, 7) of the circuit 3 by giving them a suitable length. The positive feedback circuit is designed such that it will inject energy into the resonator to compensate for the losses.

The active micro-wave resonator comprises a device C allowing frequency turning. The embodiments shown in FIGS. 1 to 3 are distinguished by the construction of this tuning device C. In the embodiment according to FIG. 1, the device C essentially comprises a variable capacitance diode 11 mounted between the ends of both coupling sections 4. In the case of FIG. 2, the diode 11 is mounted between the end of one of both sections 4 and the ground. The embodiment according to FIG. 3 comprises two variable capacitance diodes 11, each mounted between the end of one section or coupling finger 4 and ground.

The diodes may be electronically controlled in any manner known per se. They allow making the resonator tunable both in relation to its resonance frequency and its band width. The parallel connection of the diodes permits the use of so-called "vertical" diodes since they exhibit the smallest parasitic capacitance. It is advantageous to use, for instance, "vertical" diodes of the MESA type providing for a maximum variation in the impedance because of their very small parasitic capacitance. The use of two diodes 11 in parallel relationship increases the power handling behavior and variation in frequency.

It should be pointed out that the dielectric resonator according to the invention may be designed as a hybrid structure and also as an integrated structure. In the later case the transistor 8 and the variable capacitance diode 11 may be formed as an integrated circuit formed in the dielectric substrate of the resonator.

Figure 6:
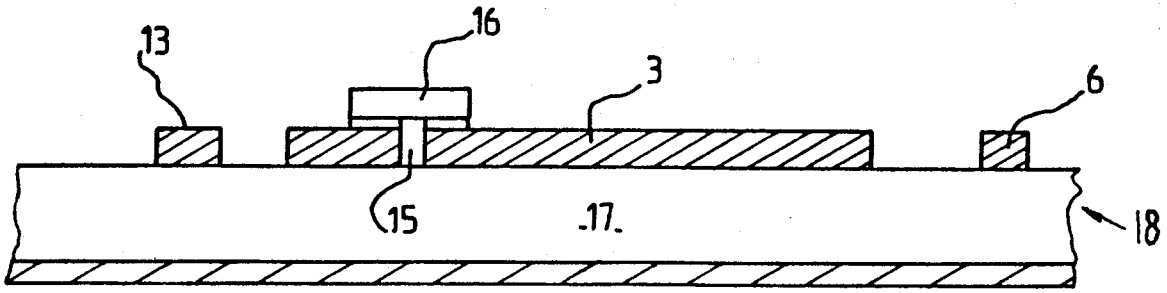
FIG. 6 is a view in section along the line VI—VI of FIG. 4.
Figure 7:
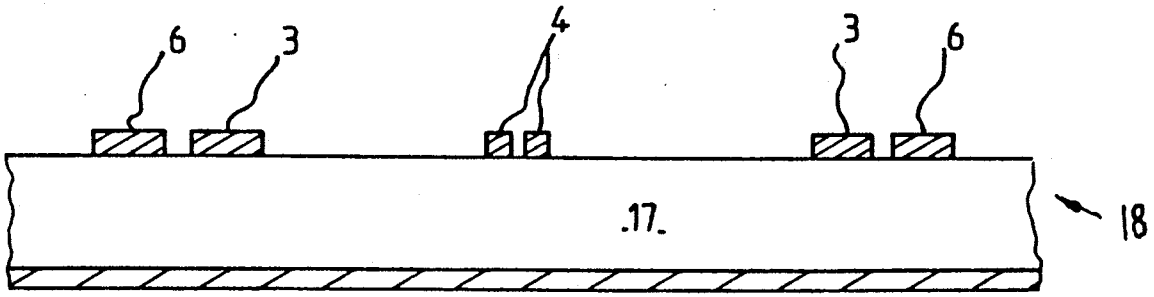
FIG. 7 is a view in cross-section taken upon the line VII—VII of FIG. 4.

FIGS. 4, 6, 7 on the one hand and FIG. 5 on the other hand show two uses of a dielectric resonator according to FIG. 3, namely a stop filter and a band-pass filter.

In the stop filter according to FIG. 4, the micro-wave transmission line shown at 13 is continuous and extends in parallel relation to the non-slotted horizontal base side of the pattern A at a suitable small distance to provide for the desired coupling quality. The voltage permitting the variation in the capacitance of the diodes 11 is applied thereto through the medium of bias inductances 14 and through corresponding micro-wave strips of the pattern A, the latter exhibiting at the base of each vertical side 3 a gap 15, across on which is mounted in parallel connecting relationship a local capacitor 16, which, however, is not necessary.

FIGS. 6 and 7 confirm that the stop filter is made according to the planar technology, the reference numeral 18 designating the substrate made from dielectric material 17 onto which are deposited the various metallic micro-wave strips.

Referring to FIG. 5, showing the band-pass filter, it uses the same resonator configuration as the stop filter of FIG. 4, the transmission line 13 being however discontinued at 19.

The resonators according to the invention are of the high overvoltage type; they are tunable and may be carried out according to the microstrip techniques or may be fully integrated onto a substrate. They are stable naturally in accordance with the temperature and exhibit a very reduced global volume or overall bulk with respect to the known technology. These resonators permit making various devices such as tunable filters with zero losses, integrated tunable sources and radiating elements.

The invention exhibits many advantages with respect to the state of the art. The coupling fingers 4 compressing two parallel micro-wave line sections lying very close to each other allow reducing the length of the "resonant" ring by selecting a length ranging up to $\lambda/10$ or $\lambda/8$, where $\lambda$ represents the wave length in the propagation line; a higher input impedance than that due to the sole capacitance of the line elements and to the couplings is brought back to the level of the resonator. The parallel connection arrangement of the diodes permits the use of so-called "vertical" diodes such as diodes of the MESA type which are characterized by very small parasitic capacitances. The use of two parallel-connected diodes increases the power handling behavior and variation in frequency.

It has proved that the use of a resonator according to the invention permits to obtaining stop filters having a rejection of 45 dB. Band-pass filters without transmission losses have been constructed which exhibit return or back losses of 35 dB at a frequency of 3.1 GHz. To reduce the coupling losses, the microstrip technique with a dielectric load may used. By using the dielectric covering layer technique, the couplings between the resonator and the input and output lines may be increased. At a central frequency of 3.1 GHz, a tuning frequency range of the order of magnitude of 47 MHz could be obtained. In this range the band width of 3 dB has been reduced from 5.13 MHz to 3.17 MHz. It appears that a broader tuning range may be obtained by a reduction in the distance between the parallel coupling lines of the hair-pin shaped resonator. In a general manner, by suitably selecting the sizes of the coupling fingers, i.e. their widths and lengths, and by a suitable arrangement of the diodes on these coupling fingers, it is possible to maximize the variation in the impedance brough back to the level of the resonator and thus to maximize the tuning frequency range.

Many variations may of course be applied to the resonator and circuit structures using these resonators without departing from the scope of the invention. Thus, various known techniques for making hybrid and integrated circuits as well as for depositing metallic microstrips may be used. Likewise the invention is not limited to the use of hair-pin shaped resonators and is only to be limited by the appended claims.

What is claimed is:

1. A dielectric resonator comprising a dielectric substrate and a first pattern comprising a metallic micro-wave strip deposited onto said substrate, the first pattern having a generally annular shape and being provided with a slot disposed transversely in a portion of the strip whereby said strip is divided into two parts by the slot, a feedback circuit comprising an active element coupled to said first pattern for providing positive feedback for injecting energy into the resonator to compensate for losses in said resonator, said feedback circuit comprising a second pattern of metallic micro-wave strips deposited on said dielectric substrate at a small distance from the micro-wave strip of said first pattern, with a portion of said feedback circuit strip extending in a parallel relationship with a portion of said first pattern strip on respective sides of said slot, at least one variable capacitance element being coupled to the first pattern strip adjacent said slot, said variable capacitance element being a voltage controlled element and further comprising a circuit for applying a voltage for controlling said variable capacitance element, said control voltage applying circuit including a part of the first pattern to which the variable capacitance element is coupled, said part of the first pattern to which the variable capacitance element is coupled being electrically connected to a control voltage source.

2. A resonator according to claim 1, wherein the active element comprises a transistor.

3. A resonator according to claim 1, wherein the first pattern comprises a hairpin shaped pattern, with said slot being defined by two parallel micro-wave strip sections extending towards the interior of the first pattern, with ends of said sections terminating in the interior.

4. A resonator according to claim 3, wherein the variable capacitance element comprises a variable capacitance diode disposed between the end of one of the sections and a ground potential.

5. A resonator according to claim 3, wherein the variable capacitance element comprises a variable capacitance diode disposed between the end of each section and a ground potential.

6. A resonator according to claim 3, wherein the variable capacitance element comprises a variable capacitance diode disposed between the ends of the sections.

7. A resonator according to claim 1, wherein the variable capacitance element comprises a variable capacitance diode of the MESA type.

8. A resonator according to claim 3, wherein the first pattern has the general form of a square having two pairs of parallel sides and the metallic micro-wave strips of the feedback circuit extend at least in part in parallel relation at a very small distance to two parallel sides of said first pattern, which parallel sides do not have the slot.

9. A resonator according to claim 1, wherein the active element and the variable capacitance element comprises an integrated circuit disposed inside the dielectric substrate of the resonator.

10. A filter comprising a dielectric resonator comprising a dielectric substrate and a first pattern comprising a metallic micro-wave strip deposited onto said substrate, the first pattern having a generally annular shape and being provided with a slot disposed transversely in a portion of the strip whereby said strip is divided into two parts by the slot, a feedback circuit comprising an active element coupled to said first pattern for providing positive feedback for injecting energy into the resonator to compensate for losses in said resonator, said feedback circuit comprising a second pattern of metallic micro-wave strips deposited on said dielectric substrate at a small distance from the micro-wave strip of said first pattern, with a portion of said feedback circuit strips extending in a parallel relationship with a portion of said first pattern strip on respective sides of said slot, at least one variable capacitance element being coupled to the first pattern strip adjacent said slot, said variable capacitance element being a voltage controlled element and further comprising a circuit for applying a voltage for controlling said variable capacitance element, said annular shaped first pattern being transversely cut by at least one gap into at least two parts defined by the gap to at least one of which part is coupled said variable capacitance element adjacent said slot, said control voltage applying circuit including a part of the first pattern to which the variable capacitance element is coupled, said part of the first pattern to which the variable capacitance element is coupled being electrically connected to a control voltage source, a transmission line being arranged on the substrate of the resonator and extending in parallel relation to a zone of the first pattern which is parallel to and opposite the portion of the first pattern having the transversely disposed slot and being arranged at a small distance from said zone.

11. A filter according to claim 10, wherein the filter comprises one of a band-pass or band-cut off filter.

* * * * *